US006398544B2

(12) United States Patent
Wright et al.

(10) Patent No.: US 6,398,544 B2
(45) Date of Patent: Jun. 4, 2002

(54) FORMED SAFETY BOTTOM FOR A CANDLE CAN

(75) Inventors: Chet Wright, Rockford; Walter P. Pietruch, Belvidere; Richard L. Peterson, Roscoe, all of IL (US)

(73) Assignee: J. L. Clark, Inc., Rockford, IL (US)

( * ) Notice: Subject to any disclaimer, the term of this patent is extended or adjusted under 35 U.S.C. 154(b) by 0 days.

(21) Appl. No.: 09/750,481

(22) Filed: Dec. 27, 2000

Related U.S. Application Data

(60) Provisional application No. 60/174,231, filed on Jan. 3, 2000.

(51) Int. Cl.[7] ..... F21V 35/00

(52) U.S. Cl. ..... 431/291; 431/289

(58) Field of Search ..... 431/289, 291; 126/43, 45; 422/125, 126; 220/212, 796

(56) References Cited

U.S. PATENT DOCUMENTS

| | | | | |
|---|---|---|---|---|
| 226,347 | A | 4/1880 | Pecor et al. | 220/62.12 |
| 2,028,798 | A | 1/1936 | Murch | 220/62.12 |
| 2,413,093 | A | 12/1946 | Warth et al. | 220/62.12 |
| 3,905,507 | A | 9/1975 | Lyu | 220/608 |
| 3,912,109 | A | 10/1975 | Essex, Jr. et al. | 220/608 |
| 4,010,867 | A | 3/1977 | Jones | 220/608 |
| 4,181,239 | A | 1/1980 | Heiremans et al. | 220/62.12 |
| 4,199,622 | A | 4/1980 | Kokumai et al. | 220/62.12 |
| 5,060,818 | A | 10/1991 | Doi et al. | 220/62.12 |
| 6,036,042 | A | 3/2000 | Pietruch et al. | 220/62.12 |
| 6,062,847 | A * | 5/2000 | Pappas | 431/291 |
| 6,155,451 | A * | 12/2000 | Pietruch et al. | 220/608 |

FOREIGN PATENT DOCUMENTS

| | | | | |
|---|---|---|---|---|
| DE | 2440068 A | * | 3/1976 | |
| DE | 2706103 A | * | 8/1978 | 431/291 |

* cited by examiner

*Primary Examiner*—Sara Clarke
(74) *Attorney, Agent, or Firm*—Leydig, Voit & Mayer, LTD

(57) ABSTRACT

This invention is directed to a candle can of the type normally filled with an ignitable fuel. The candle can includes an upstanding continuous sidewall that is integrally coupled to a stamp formed candle can bottom structure at an outer periphery of the candle can bottom structure. The integral coupling of the sidewall to the bottom structure establishes a can support ring to engage a support surface. The stamp formed can bottom structure is so formed as to provide within the can an internally upwardly directed dome upon which a candlewick carrying element may be securely located within a dish shaped indentation in an apex region of the dome. In a preferred embodiment of the invention the intersection of the sidewall and the upwardly directed dome of the can bottom structure establishes an annular internal volume of fuel separated by the dome from a candlewick flame near the end of both the candlewick life and the supply of fuel. This just described arrangement of an annular internal volume of fuel which surrounds the dome minimizes flash-over while also creating the annular ring supporting surface for the candle can base which reduces heat transfer from the candle fuel and flame to the support surface.

20 Claims, 4 Drawing Sheets

FORMED SAFETY BOTTOM FOR A CANDLE CAN

RELATED APPLICATION

This application claims benefit of U.S. Provisional Patent Application Serial No. 60/174,231, filed on Jan. 3, 2000, and owned by the instant assignee, the entire disclosure which is hereby incorporated by reference.

FIELD OF THE INVENTION

This invention relates to metal containers, and more particularly to container bottoms adapted for use in candle cans.

BACKGROUND OF THE INVENTION

Candles are often merchandised in decorative containers to present a package attractive to the purchasing consumer. A number of factors impact the design of a successful can for a candle, and they cover a range of factors including economy and ease of manufactureability, decorativeness, ability to reliably contain the molten wax and overall safety, as examples.

In recent years there has been an explosive growth in the use of scented candles in homes and business. In home environments the aromas released by the scented candle wax burned by candlewicks frequently are selected for the seasonal ambiance their burning evokes. Lilac in the spring, rose in the summer, pine in the fall or winter or whatever fragrance suits ones fancy. In business settings there are those that believe the aromas selected have therapeutic values with some individuals believing that citrus aroma heightens mental acuity. Most everyone is familiar with glass candle holders now in common use. Even if the outsides of the glass are decoratively finished, when the candle wax is depleted the transparent nature of the glass reveals the burned out condition of the candle which is not attractive. Enter highly decorative finished metal cans that look beautiful at all stages of their life. Even when empty they are considered by many to be worthy of collection. The downside of using metal cans to accommodate burning candles is well known and derives from the fact that the thermally conductive nature of metal frequently allows transmission of harmful quantities of heat from not only the flame but from the heated and liquefied candle wax which heat passes through the can base to a support surface which may be damaged by the heat.

Candle flash-over is also a danger. As is known, flash-over can occur when the pool of wax in the bottom of a candle can becomes relatively shallow, the wick burns down to approach the shallow pool, the pool becomes hotter than normal, and ultimately may reach a self sustained combustion temperature at which the wax will burn without a need for a wick. The candle can may then reach temperatures significantly in excess of 600° F. and thereby presents a significant fire hazard.

The engine that drives competition is the seemingly never ending effort to discover simpler and simpler manufacturing procedures that reduce unit cost and enhance competitive pricing. It is in response to this quest for simplification that the subject invention provides an answer.

Pappas, U.S. Pat. No. 5,842,850 describes various approaches to preventing flash-over. These approaches deal primarily with keeping the wick, i.e. the source of candle ignition, sufficiently above the floor of the candle container which makes the flame go out before the fuel exceeds its flash point temperature. The '850 patent typically employs a candlewick sustainer wherein the wick is held in a bore formed in the sustainer. The bore which contains the wick is centrally disposed in a vertical column that is supported by a base made impervious to candle fuel which thereby ensures that no candle fuel can reach the wick through the base that supports the bore containing the candlewick. Because the wick must be in contact with the liquefied wax it burns, it follows that the height of the sustainer column determines when the wick will lose its supply of fuel. The '850 patent indicates that the top end of the column extends above the floor of the candle container an amount sufficient to prevent flash-over. In several embodiments the '850 patent includes a centrally disposed pedestal upon which is mounted the afore described candlewick sustainer. The '850 patent notes that where the candle container is of stamped metal the pedestal can be stamped into the container during manufacture.

The subject invention distinguishes over the '850 patent in a number of novel and beneficial ways, most significantly in the provision of a stamp formed can bottom that uniquely elevates the candlewick holder in a dish to deprive the candlewick of burnable wax and prevent possible flash-over, while it also serves as a means to locate the candlewick holder prior to filling the can with wax. The stamp formed bottom also isolates heated liquefied wax to an outer periphery of the can bottom remote from the candle flame.

The unique bottom structure furthermore elevates the burning wick in such a manner that there is provided an insulating air space centrally disposed beneath the burning wick and the stamp formed bottom. The unique bottom structure additionally provides an annular surface ring that engages any surface upon which the candle can is placed further ensuring a minimal transfer of heat through the bottom of the candle can which might scorch and mar the supporting surface.

SUMMARY OF THE INVENTION

This invention is directed to a candle can of the type normally filled with an ignitable fuel. The candle can includes an upstanding continuous sidewall that is integrally coupled to a stamp formed candle can bottom structure at an outer periphery of the candle can bottom structure. The integral coupling of the sidewall to the bottom structure establishes a can support ring to engage a support surface. The stamp formed can bottom structure is so formed so as to provide within the can an internally upwardly directed dome upon which a candlewick carrying element may be securely located on an apex region of the dome.

In a preferred embodiment of the invention the intersection of the sidewall and the upwardly directed dome of the can bottom structure establishes an annular internal volume of fuel separated by the dome from a candlewick flame near the end of both the candlewick life and the supply of fuel. This just described arrangement of an annular internal volume of fuel which surrounds the dome minimizes flash-over while also creating an annular ring supporting surface for the candle can base which reduces heat transfer from the candle fuel and flame to the support surface.

In the preferred embodiment the dome and its apex region are optimized to prevent accumulation of carbon balls or particles near the wick, thus avoiding another source of flash-over.

In another embodiment of the invention the dome has a cone shape or is provided with a uniform radius of curvature.

In yet another embodiment of the invention the dome entirely spans the can base.

It is therefore a primary object of this invention to provide a candle can which is economical to mass produce, yet includes an insulating and highly effective flash-over prevention safety bottom.

According to a particular aspect of the invention, it is an object of the invention to provide a safety bottom for a candle which substantially reduces the area of contact between the can with its supporting surface, positions the candle can support surface contact area remote from the flame, and provides a dome shape wick support structure to minimize the possibility of flash-over.

Another object is to provide a candle can bottom configuration, and a method for forming that configuration, which is adaptable to both deep drawn containers and containers having a seamed construction. In providing adaptability, it is a feature of the invention that the bottom configuration is adaptable to cylindrical and non cylindrical configurations, but in all cases provides a structure wherein a central wick support dome is raised above a candle floor base by means of a sloping connecting wall.

Thus it is a feature of the invention to provide a candle can bottom structure which can be readily stamp formed, either during a drawing process for forming a single piece can, or in manufacture of the can bottom, all without the danger of so-overstretching the material of the bottom so as to create the possibility of pinholes, leaks or tears.

It is yet another object of the invention to provide a specially formed candle can having a bottom configuration which has a relatively small area annular ring at its base, so that when the base rests on a surface, contact with that surface is limited to the annular ring and an insulating air space which keeps most of the can bottom out of contact with the supporting surface. In one embodiment of the invention the area of contact with the surface is further diminished by the inclusion in the annular ring of protuberances i.e. bumps that further space the candle can from the surface that supports the candle can.

It is a further feature that the annular ring is positioned in a portion of the can where the wax is least likely to melt, with a dome shaped wick support being arranged to prevent flash-over and limit melting of a thicker portion of the wax at the outer periphery of the can. In that regard, the peripheral base remains at a somewhat lower temperature, so as to avoid scorching the table or other supporting surface.

These and other aims, objectives, and features of the invention will become more apparent from the following detailed description when taken in conjunction with the accompanying drawings, in which:

DETAILED DESCRIPTION OF THE PREFERRED EMBODIMENT

Figure 1:
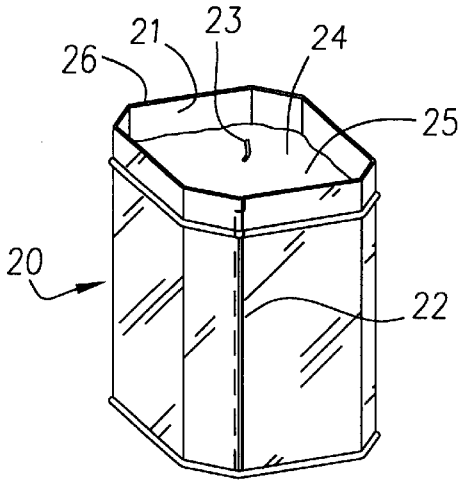
FIGS. 1, 2 and 3 are perspective illustrations of a variety of different types of metal candle cans filled with a wick and wax in which the subject invention finds utility.
Figure 2:
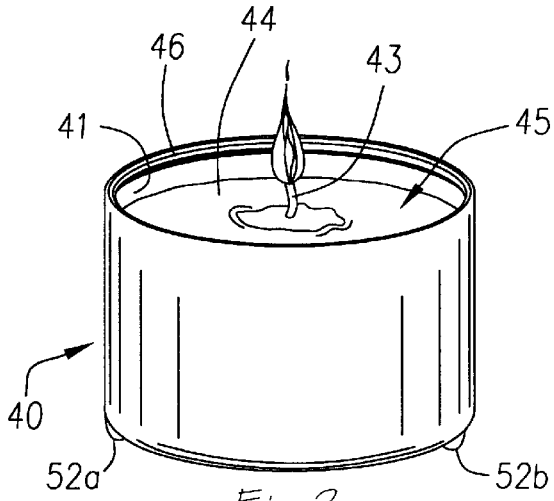
Figure 3:
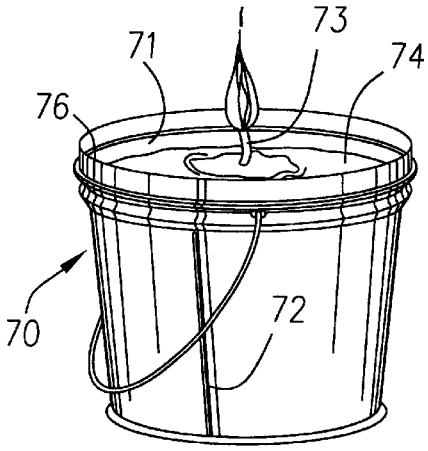
Figure 4:
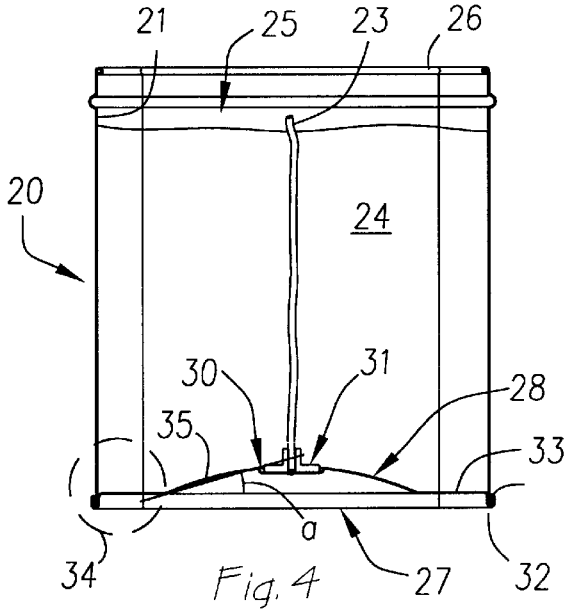
FIG. 4 is a full cross-section of the candle can of FIG. 1.

Reference is now made to FIGS. 1, 2 and 3 which depict the overall appearance of a variety of candle can designs. Specifically the candle can 20 of FIG. 1 includes as part of an integrated structure an upstanding continuous sidewall 21. The upstanding continuous sidewall 21 is made continuous by means of a sidewall seam 22, the details of which do not form a part of the invention and are therefore not shown in detail. Although not shown in FIG. 1 the candle can 20 has a stamp form can bottom generally indicated by reference arrow 27 which is clearly shown in FIG. 4. FIG. 4 depicts a full cross-section of the candle can 20 of FIG. 1.

Figure 5:
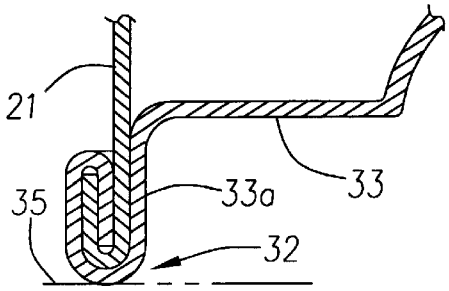
FIG. 5 is a cross-section of an annular hem or ring surface support structure of a bottom portion shown in a broken line circle in the lower left corner of FIG. 4.

Within an open top 25 of the candle can 20) there is shown candle wax 24 and candlewick 23. It is to be understood that the term wax,ignitable fuel, and fuel will be used interchangeably hereinafter to mean the same thing. The upstanding continuous sidewall 21 is provided with a finished edge 26. At the bottom of candle can 20 in FIG. 4 it will be observed that the upstanding continuous sidewall 21 is integrally coupled to the stamp form can bottom structure 27 at a point generally indicated by broken line circle 34. The details of this integral union of upstanding continuous sidewall 21 and stamp formed can bottom structure 27 can best be seen in FIG. 5 which provides a detailed showing of how the upstanding continuous sidewall 12 physically cooperates with an annular sidewall rim 33 and support ring flange 33*a* of the stamp formed can bottom structure 27. Support ring flange 33*a* and annular sidewall rim. 33 can best be seen in FIG. 6. The structure of FIG. 5 provides what is frequently termed a rolled seam or hem which creates an annular can support ring 32 that cooperates with a support surface 35 shown as a broken line.

Figure 6:
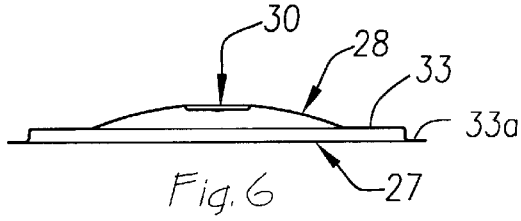
FIG. 6 is an unsectioned view of a dome shaped can bottom for the can shown in section in FIG. 4.

FIG. 4 and FIG. 6 when studied together reveal the stamp formed bottom structure 27 that includes an internally upwardly directed dome 28 upon which a candlewick holder or sustainer 31 is shown securely located within a dish shaped indentation 30 in an apex region of the internally upwardly directed dome 28. One function of the dish shaped indentation 30 is to securely hold the candlewick holder 31 in place during a subsequent melted wax filling process. In most cases the presence of the dish shaped indentation 30 avoids the need to secure the wick holder in place with an adhesive as is done in the prior art. Further advantages of the dish shaped indentation 30 will be explained in detail in the descriptions of FIGS. 2, 7 and 8 that follow.

Figure 7:
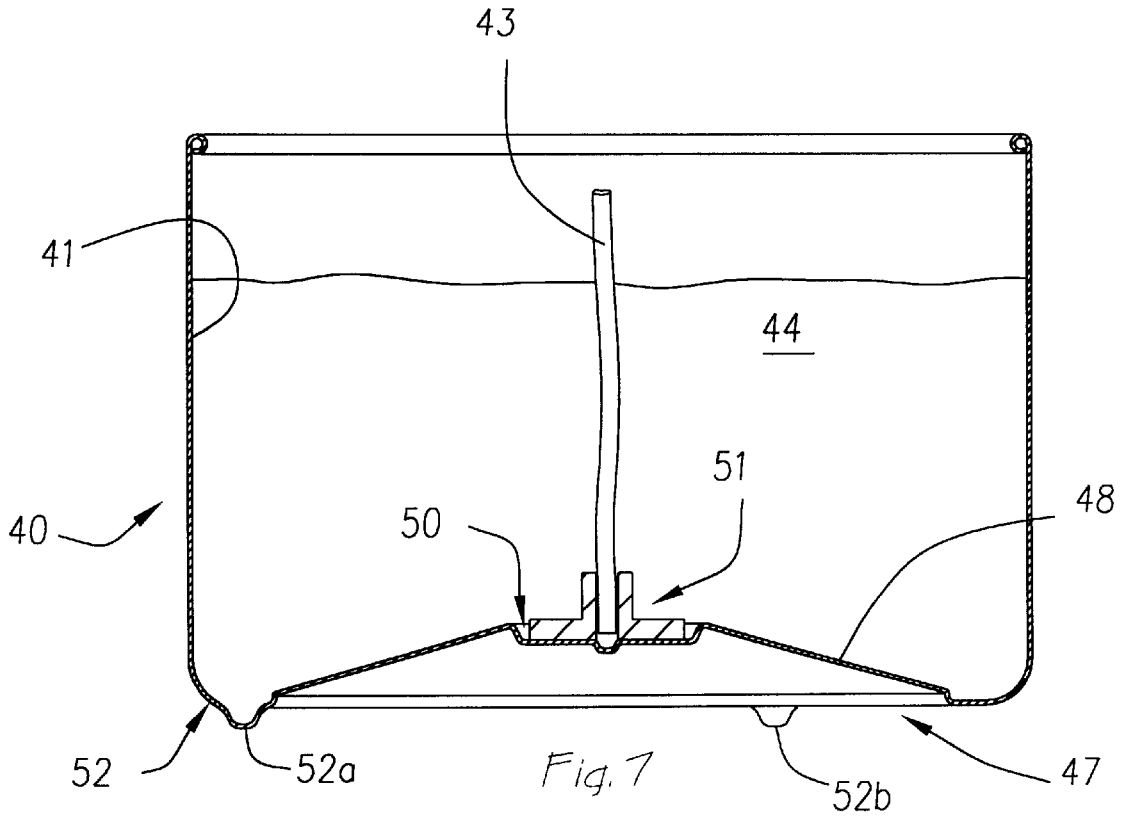
FIG. 7 is a full section of a candle can of the type shown in FIG. 2, with a candle flame removed.
Figure 8:
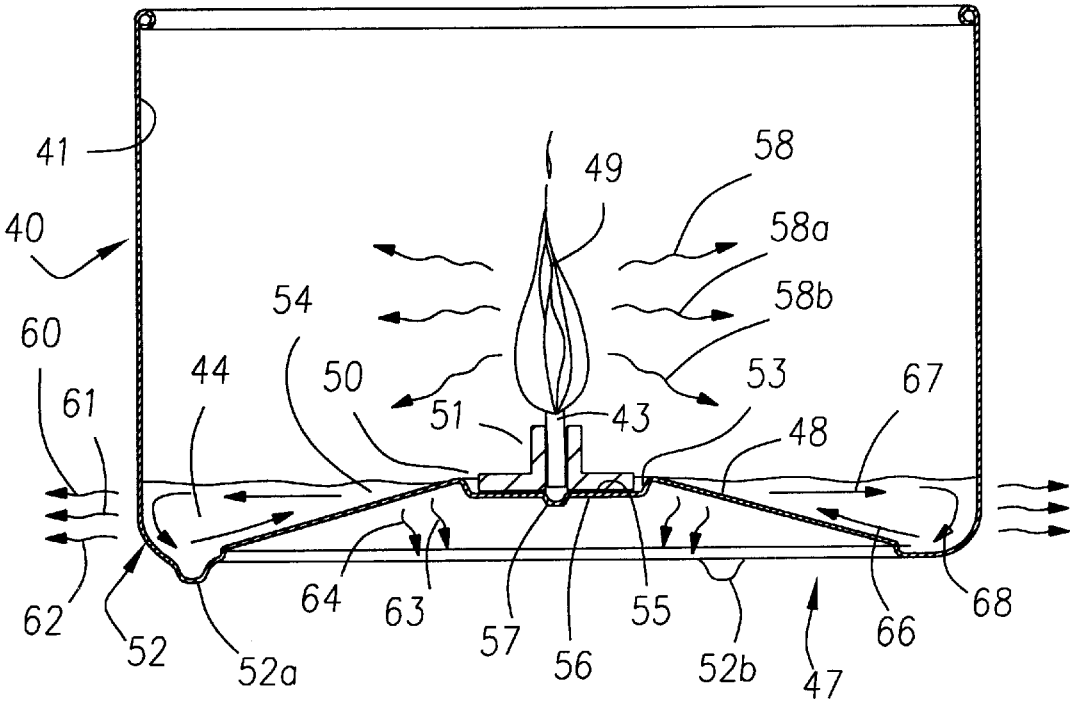
FIG. 8 is a partial section view of a candle can of the type depicted in FIGS. 2 and 7 wherein the candle flame is in a final burn state.

Accordingly FIGS. 2, 7 and 8 illustrate a unitary metal can structure which embodies the invention. This unitary can structure is also shown and its method of manufacture is fully described in my copending application Ser. No. 09/749,617 filed concurrently with the subject application, the disclosure and teachings of which are incorporated herein by reference.

This unitary can structure is to be distinguished from the cans of FIGS. 1 and 3 in that it is made of a single sheet of metal that has its cylindrical shape deep drawn and the can bottom stamp formed after the cylindrical shape has been completed. Accordingly, with specific reference to FIGS. 2 and 7, the seamless candle can 40 includes a continuous vertically deep drawn side wall 41 that transitions through a stamp formed curved can wall region, as shown, into stamp formed can bottom 47 that includes an internal upwardly directed cone shaped dome 48. A candlewick holder or sustainer 51 and associated candlewick 43 is shown securely located within a dish shaped indentation 50 in an apex region of the cone shape dome 48. The aforementioned curved can wall region between deep drawn sidewall 41 and the stamp formed can bottom 47 creates an annular can support ring 52. The annular can support ring 52 may also be provided with bumps such as those denoted by reference numerals 52*a* and 52*b* in FIG. 2 and FIGS. 7, 8, the presence of which further diminish the area of contact of the candle can 40 with a support surface not shown. The bumps would be created during the bottom forming process.

The curved surface annular can support ring 52 and the deep drawn sidewall 41 cooperate to establish an annular internal volume of candle wax 44 separated by the cone shaped dome 48 from candlewick 43 and associated candle flame 49 near the end of both the candlewick life and the supply candle wax fuel 44 which thereby minimize flash-over while also creating the annular curved surface support ring 52.

The thermal dynamic nature of flash-over prevention uniquely afforded by the subject invention will now be explained in conjunction with the illustration of the invention as it is embodied in FIG. 8.

FIG. 8 shows the deep drawn unitary metal candle can of FIGS. 2 and 7 with the position of the candlewick 43, its candle flame 49 and candle wax 44 which acts as a fuel for the candle flame 49 near the end of both the life of the candlewick 43 and the candle wax fuel supply 44. It will be observed that the cone shaped dome structure 48 cooperates with the deep drawn sidewall 41 to form an annular pool of candle wax 44 with an overall configuration of a donut. It will be observed that at an inwardly directed region 54 there is an increasingly diminishing depth of wax in the vicinity of the lip 53 of the dish shaped indentation 50.

As the temperature of the candle wax 44 increases due to the radiant energy indicated by wiggly arrows 58, 58*a*, 58*b* from candle flame 49 the wax viscosity decreases. It is known that decreased viscosity of a candlewick fuel enhances capillary movement of liquefied wax in the candlewick 43. It will be appreciated in a study of FIG. 8 that the candlewick 43 and wick holder or sustainer 51 positioned in dish shaped indentation 50 receives its wax as a liquefied fuel via a thin film of liquefied wax 55 that exists between the wick holder 51 and a planar bottom 56 of the dish shaped indentation 50. The planar bottom 56 also may include a dimpled or slight depression 57 centrally disposed within the dish shaped indentation 50. This dimple or slight depression 57 creates a small pool of liquefied wax which cooperates with candlewick 43 by means of capillary action to furnish fuel for the candle flame 49.

The slope of the cone shaped dome 48 coupled with the effect of gravity of the heated liquid wax cooperate to cause heated liquid wax in the inwardly directed region 54 of molten wax near the lip 53 to move first upwardly along the cone shaped dome 48 and then outwardly as convection current arrows 66, 67, 68 indicate. This results in molten wax moving towards the center of the can 20 where the candlewick 43 is mounted in candlewick holder 51. The lip 53 creates a sharp or definitive interruption of the conically sloped wall 48 which prevents the molten wax from entering the dish shaped indentation 50. With no liquefied wax entering the dish shaped indentation 50, the liquefied wax 55 between the wick holder 51 and its wick 43 is soon depleted and the wick 43 and flame 49 are starved for fuel and the flame 49 quickly goes out.

The metal composition of the cone shaped dome 48 in the vicinity of the lip 53 of the dish shaped structure 50 and the deep drawn sidewall 41 cooperate to provide a thermal mechanism to simultaneously allow radiational cooling of heated wax as indicated by thermal radiation arrows 60, 61, 62, 63 and 64 to thereby diminish the temperature of the liquefied wax and further minimize the possibility of flash-over.

In practicing certain aspects of the invention it has been found important to provide in a preferred example such as the unitary seamless metal can structure of FIGS. 2, 7 and 8, a can support surface that occupies no more than about 30% of the total bottom area and most preferably even less. Accordingly, the unitary seamless metal can has a 2.5 inch diameter and the annular can support ring 52 is only about 0.19 inches wide, such that the 0.38 inch total (2 sides) in a 2.5 inch can amounts to about 15% on a diameter basis and about 28% on an area basis. Considering that the drawing operation will preferably have a smooth curve merging the sidewalls into the annular support ring 52 it will be seen that substantially less than 30% of the bottom area will be in contact with the underlying surface. This minimizes heat transfer to the surface, while still providing a very stable support.

Of the approximately 70% of the area of the can (in the preferred embodiment) which is raised, typically the cone shaped dome 48 will require a circular mounting area of about 0.50 inches diameter for placement of the conventional wick holder 51. Thus, FIGS. 7, 8 show a dish shaped locating structure 50 which creates a seat for the wick holder 51 which is slightly greater than 0.50 inches in diameter, centered on the bottom of the can and raised in the preferred embodiment of the 2.5 inch can approximately 3/16 inch above a support surface, not shown. The height of the seat and the height of the wick holder 51 are coordinated to achieve the 0.50 inches or more height for the flame at the point if extinguishment. The lip 53 need be only about a 1/16 inch in height to provide a secure dish shaped seat for the wick holder 51. A shallow dimple 57 in the center of the dish shaped indentation 50 ability to assure that the wick holder 51 rests flat in its seat, even if the wick protrudes through an aperture in center of the wick holder 51. The wick holder 51 and wick 43 will thus be held reliably in position as wax is poured into the can to form the completed candle.

The sloped conical wall which joins the cone shaped dome 48 to the annular support surface 52 in the preferred 2.5 inch diameter can, is formed at an angle in the range between about 15 and 60 degrees and most preferably the angle is in the range between about 15 and 45 degrees. Forming the angle much sharper will allow the cone shaped dome 48 to be raised, but will require greater stretching of the material of the central portion of the blank, creating the possibility of perforating the underside. Forming the angle of the surface of the cone shaped dome at an angle of less than about 15 degrees achieves insufficient raising of the central region of the cone shaped dome requiring a wick holder with an unworkably long neck. We have found that using a material of about 0.009 inches in thickness, and forming the angle at about 23 degrees for a 2.5 inch diameter can, provides sufficient material in the central portion of the blank to allow the formation of the complex shape by stretching of that material as the mating surfaces of the die are driven into contact at the end of the drawing operation.

In the example of the seamed can of FIGS. 1 and 4, a line 35 which intersects a lip of the dish shaped indentation 30 of the dome 28 and a plane that includes the bottom of the dome should be at an angle "a" in the range of about 15 and 60 degrees and most preferably in the range of 15 to 45 degrees. Where the diameter of the curve shaped dome 28 in the plane that includes the bottom of the dome is about 2 inches.

Figure 9:
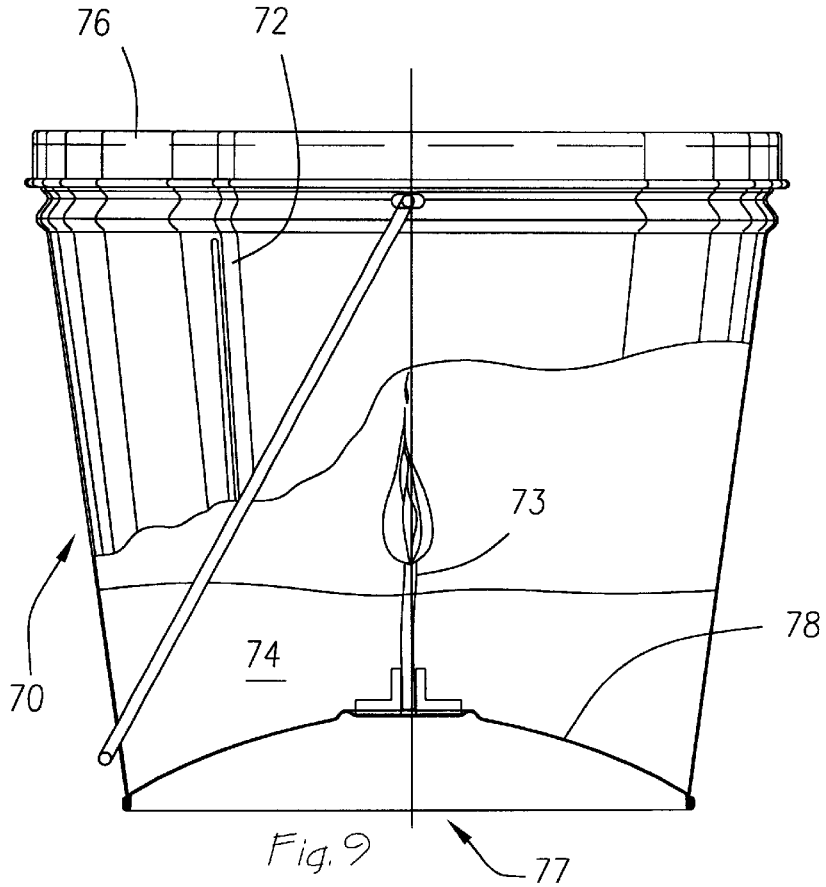
FIG. 9 is a partial cross-section of the candle can of FIG. 3.
Figure 10:
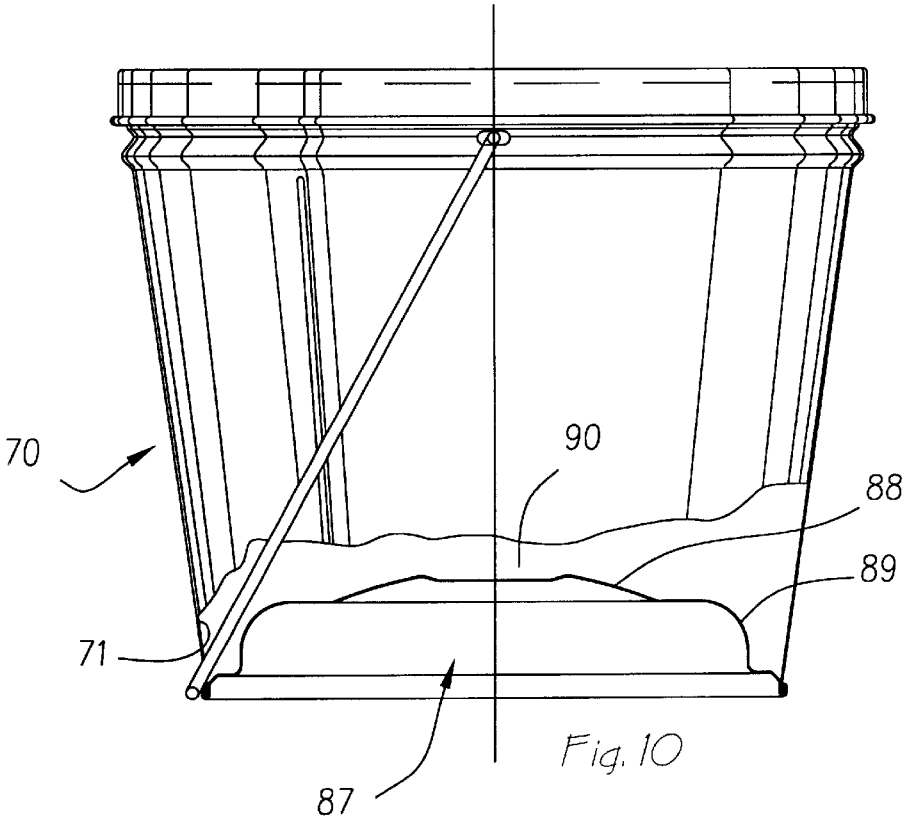
FIG. 10 is a partial section of a can bottom and sidewall structure that depicts yet another type of formed candle can bottom.

Turning now to the tapered candle can 70 of FIGS. 3, 9 and 10 which when taken together with the description that follows will explain yet another embodiment of the invention. The tapered candle can 70 of FIG. 3 is much like the preceedingly described candle cans in that the tapered candle can 70 includes an upstanding continuous sidewall 71, sidewall seam 72 and sidewall finished edge 76. The can is filled with candle wax 74 and a candlewick 73. In this embodiment of the invention attention will be directed to yet another novel construction of stamp formed can bottoms 77, FIG. 9 and 87, FIG. 10.

In the embodiment of the invention in FIG. 9 the stamp formed can bottom 77 takes on a dome shape that may be described as a segment of a hemisphere 78 which entirely spans the base of the tapered can 70. In FIG. 10 the stamped formed can bottom 87 is made up of a cone shaped region 88 near the apex surrounding the dish shaped indentation 90 as well as an annular partial toroid shape 89. FIG. 9 is rather straightforward to stamp. FIG. 10 has a somewhat more complex shape, but has the advantage of less "waste" wax remaining in the can after the flame extinguishes.

The previous embodiments all show the feature of a dish shaped indentation at the apex of the dome. Among the features provided by the dish shaped structure is the ability to positively locate the base of the wick holder. However, that feature is provided at the expense of a slight, but measurable, decrease in elevation of the wick holder. In some situations, it is possible to dispense entirely with the dish shaped indentation. Particularly, when the candle manufacturer adopts a process by which the base of the wick holder is glued to the bottom of the can (as by a drop of adhesive applied just before positioning the wick holder) the dish shaped depression may be dispensed with, particular in the case where the pedestal will provide a definite target to receive the base of the wick holder to assure its centering.

Figure 11:
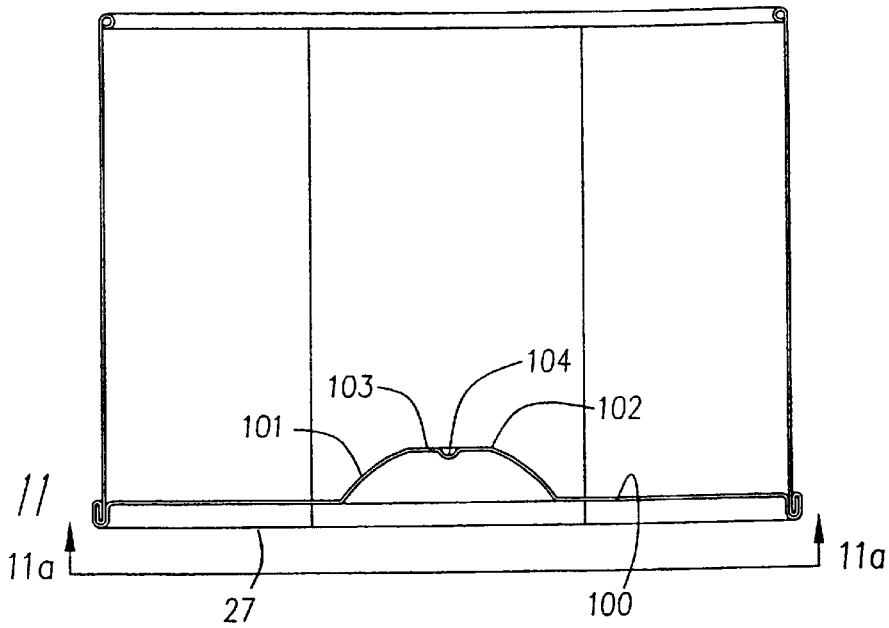
FIG. 11 is a partial section of a seamed metal container illustrating a preferred embodiment of the invention.
Figure 11A:
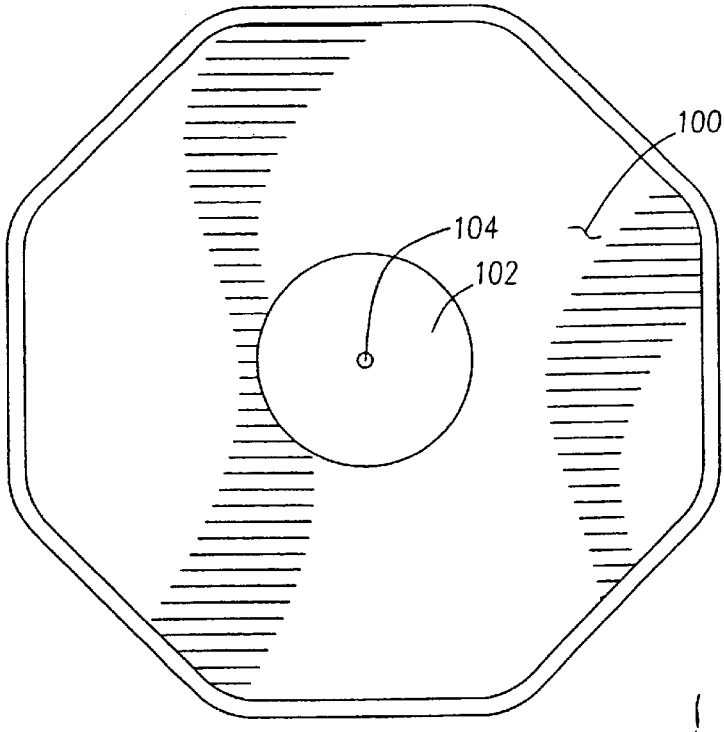
FIG. 11*a* is bottom view of FIG. 11.

Such an arrangement it illustrated in the currently preferred embodiment of FIGS. 11 and 11*a*. It will be appreciated, however, that the flat-top domed structure of these figures can be accommodated in any of the previous embodiments, where desired.

Figure 11B:
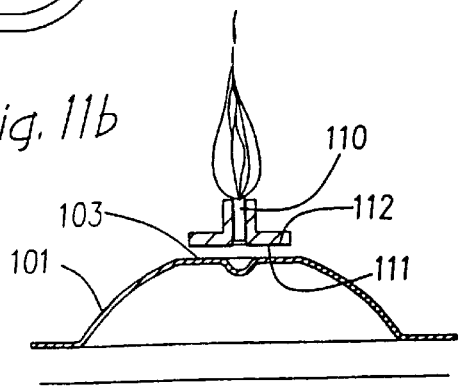
FIG. 11*b* is a partial section of the bottom structure of the metal container depicted in FIG. 11 with an associated wick.

The embodiment of FIGS. 11 and 11*a* illustrates the approach of providing a bottom structure 27 having a relatively flat peripheral portion 100 and a smaller diameter but rapidly rising dome structure 101 at the center thereof. The dome structure has relatively sharply rising walls 102 which terminate in a flat, undepressed plateau 103 at the center thereof. A dimple 104 can be provided in the center of the top plateau 103. In practice, a wick holder 110 (see partial view FIG. 11*b*) is positioned atop the plateau 103 of the dome 101 and held in place by means of adhesive 111 between the base 112 of the wick holder 110 and the plateau 103. A drop of adhesive can be applied to the base of the wick holder before it is put in position, the adhesive being sufficiently tacky to maintain the position of the wick holder during the candle pouring operation.

The candle bottom structure of FIG. 11 has been found to provide a further benefit over certain of the earlier embodiments. When a candle has burned for a considerable length of time, carbon balls tend to collect in the wax. The carbon balls can form from dislodged and burnt bits of the wick, from a portion of the match which is used to light the candle, or other sources. It is also known that if the carbon balls are concentrated in the center of the can, near the wick which generated them, they will serve as a further source of ignitable material and exacerbate the flash-over problem.

We have found that the shape of the domed configuration can have a material effect on the location of the carbon balls as the candle burns to the extinguishment point. More particularly, with the more gently shaped dome structures, such as in FIGS. 4, 7 and 9, the carbon balls tend to collect where they fall, very near the base of the wick holder. As in that configuration, they sometimes themselves ignite, triggering the flash-over problem. We have also found that with a base structure having a dome of smaller diameter than the domes of FIGS. 4, 7 and 9, yet having relatively sharply sloped sides of the dome, the carbon balls tend to disperse away from the center of the candle. We have found that with the dome as generally depicted in FIG. 11, the carbon balls will move a sufficient distance from the center of the flame that they are unlikely to serve as a secondary ignition source and trigger flash-over.

The degree of slope of the walls of the dome is dependent on a number of factors. One of them is the carbon ball positioning problem, and for that the walls should be as sharp as possible as illustrated in FIG. 11. However, that configuration suffers from the disadvantage of a relatively large volume of wax remaining in the can after the wick is extinguished. The shape of FIG. 7, however, has much less wax remaining in the can after extinguishment, although at the expense of less travel of the carbon balls from the center of container. Depending on the size of the container and other factors, including the end use of the final candle, these factors can be balanced to achieve a desired result in accordance with the present invention. In all cases, however, the finished product is of the same variety, with the seams reliably sealed for use in applications involving elevated temperatures.

The seamed candle cans of FIGS. 1 and 3 show that seams 22, 72 and the bottom hem seam of FIG. 5 free of any additional means to hermetically seal these seams. In actual commercial use the best mode of practicing the subject invention contemplates that cans be provided with an internally sprayed sealant shown and described fully in U.S. Pat. No. 6,036,042, assigned to the same assignee as the subject application.

From the forgoing, it will be appreciated that the present invention brings to the art a metal container having a bottom structure formed to create a dome upon which a candle wick holder may be positioned thereby significantly reducing the possibilities of flash-over and any thermal damage to a supporting surface for the container. The dome has a flat mounting surface for receiving a wick holder, and the flat mounting surface may be located at the apex of the dome, or slightly depressed in a dish-shaped indentation adapted to receive and locate the wick holder. The size and shape of the dome may be optimized, depending upon the size of the container and other factors, such that the accumulation of carbon balls or particles near the wick may be prevented, thereby further reducing the possibility of flash-over.

What is claimed is:

1. A candle can to be filled with a candlewick and supply of ignitable fuel, the candle can comprised of:

an upstanding sidewall connected to a bottom wall at an outer periphery of the candle can bottom wall to create an annular can support ring to engage a support surface;

the bottom wall including an internally upwardly directed dome having a generally flat mounting surface located proximate an apex of the dome upon which a candlewick carrying element may be securely located, the dome meeting the mounting surface at an annular edge;

the flat mounting surface being raised at least 3/16 of an inch above a surface support plane that includes a bottom surface of the annular can support ring;

the dome being constructed so that a line at an acute angle of between 15 and 60 degrees will intersect the annular edge and a plane that includes the bottom of the dome.

2. The candle can of claim 1, wherein the annular edge includes a raised lip that establishes a discontinuity in the surface of the dome, the lip effectively interrupting the flow of fuel to the candlewick when a candlewick flame nears the end of both the candlewick life and the supply of fuel to thereby minimize flash-over.

3. The candle can of claim 2 wherein the dome shape has a uniform radius of curvature except in area of the generally flat mounting surface.

4. The candle can of claim 2 wherein the dome spans the entirely bottom wall.

5. The candle can of claim 2 wherein the dome is centered in the can bottom wall and spaced from the sidewall.

6. The candle can of claim 2 wherein the dome includes a cone shaped portion surrounding the generally flat mounting surface in the apex region of the dome, the dome including a partial toroid portion surrounding the cone shaped portion.

7. The candle can of claim 1, wherein an intersection of the sidewall and the upwardly directed dome of the can bottom structure establishes an annular internal volume of fuel separated by the dome from a candlewick flame near the end of both the candlewick life and the supply of fuel which thereby minimizes flash-over while also creating the annular support ring surface for the candle can base to thereby reduce heat transfer from the candle fuel and candle flame to the support surface.

8. The candle can of claim 2 wherein the dome is cone shaped.

9. The candle can of claim 1, further comprising a dish shaped indentation in the apex region of the dome, a bottom of the dish shaped indentation defining the generally flat mounting surface, the annular edge defining an outer periphery of the dish shaped indentation.

10. The candle can of claim 9, wherein the annular edge includes a raised lip that establishes a discontinuity in the surface of the dome.

11. The candle can of claim 10, wherein the raised lip is raised at least 1/16 of an inch.

12. The candle can of claim 1, wherein the bottom wall has a diameter of about 2.5 inches and the dome is constructed so that the line intersecting the annular edge and the plane is at an acute angle of between 20 and 25 degrees.

13. The candle can of claim 1, wherein the dome is constructed so that a line at an acute angle of between 15 and 45 degrees will intersect the annular edge and a plane that includes the bottom of the dome.

14. The candle can of claim 1, wherein the dome is curve shaped.

15. The candle can of claim 1, wherein the dome covers at least 70% of the are a of the bottom wall.

16. A candle can to be filled with a candlewick and supply of ignitable fuel, the candle can comprised of:

an upstanding sidewall coupled to a stamp formed candle can bottom structure at an outer periphery of the candle can bottom structure to create an annular can support ring to engage a support surface, the stamp formed can bottom structure including an internally-upwardly directed dome and, a dish shaped indentation in an apex region of the dome in which a candlewick carrying element may be securely located on a bottom surface of the indentation, the bottom surface of the dish shaped indentation is raised at least 3/16 of an inch above a surface support plane that includes a bottom surface of the annular can support ring, the dish shaped indentation including a raised lip at an outer periphery of the indentation, the dome is so constructed that a line at an acute angle of between 15 and 60 degrees will intersect the lip and a plane that includes the bottom of the dome.

17. The candle can of claim 16 wherein the dome entirely spans the bottom wall.

18. The candle can of claim 16, wherein the raised lip is raised at least 1/16 of an inch.

19. The candle can of claim 16, wherein the can bottom structure has a diameter of between 2 and 3 inches and the dome is constructed so that a line at an acute angle of between 20 and 25 degrees will intersect the raised lip and a plane that includes the bottom of the dome.

20. The candle can of claim 16, wherein the dome covers at least 70% of the area of the can bottom structure.

* * * * *

UNITED STATES PATENT AND TRADEMARK OFFICE

CERTIFICATE OF CORRECTION

PATENT NO. : 6,398,544 B2
DATED : June 4, 2002
INVENTOR(S) : Chet Wright et al.

It is certified that error appears in the above-identified patent and that said Letters Patent is hereby corrected as shown below:

Column 10,
Line 13, change "are a" to -- area --

Signed and Sealed this

Sixteenth Day of July, 2002

*Attest:*

*Attesting Officer*

JAMES E. ROGAN
*Director of the United States Patent and Trademark Office*